US007063061B2

(12) United States Patent
Nagao et al.

(10) Patent No.: US 7,063,061 B2
(45) Date of Patent: Jun. 20, 2006

(54) LIQUID QUANTITY VISUAL CONFIRMATION DEVICE AND RESERVOIR-FORMING MEMBER

(75) Inventors: Yoshiaki Nagao, Vernon Hills, IL (US); Toshio Takahashi, Koganei (JP); Liu Yumin, Fussa (JP); Yukio Sawadate, Akishima (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/832,327

(22) Filed: Apr. 27, 2004

(65) Prior Publication Data

US 2004/0216713 A1 Nov. 4, 2004

(30) Foreign Application Priority Data

May 1, 2003 (JP) ..... 2003-126394

(51) Int. Cl.
*F02F 7/00* (2006.01)
*G01F 23/02* (2006.01)

(52) U.S. Cl. ..... 123/195 R; 123/196 R; 73/323; 184/96

(58) Field of Classification Search ..... 123/195 R, 123/195 A, 195 C, 196 R, 198 E; 220/377, 220/602, 662, 663; 73/323; 184/96
See application file for complete search history.

(56) References Cited

U.S. PATENT DOCUMENTS 2,755,629 A * 7/1956 Baisch ..... 60/534
5,025,764 A * 6/1991 Kobayashi et al. ..... 123/196 R
5,758,746 A * 6/1998 Sage ..... 184/96

FOREIGN PATENT DOCUMENTS

JP 63-73515 5/1988

* cited by examiner

*Primary Examiner*—Andrew M. Dolinar
(74) *Attorney, Agent, or Firm*—Michael Bednarek; Pillsbury Winthrop Shaw Pittman LLP

(57) ABSTRACT

A liquid quantity visual confirmation device comprises a first reservoir-forming member, and a second reservoir-forming member forming a liquid reservoir in combination with the first reservoir-forming member. The second reservoir-forming member is at least partially transparent to allow visual confirmation of the internal liquid level from an outside thereof. The second reservoir-forming member has a liquid-feeding port for feeding the liquid into the liquid reservoir. The quantity of liquid in the liquid reservoir can be confirmed by looking at the internal liquid level in the second reservoir-forming member from the outside. It is also possible to reliably feed the liquid into the liquid reservoir from the liquid-feeding port while confirming any rising of the liquid level through the transparent portion.

3 Claims, 3 Drawing Sheets

LIQUID QUANTITY VISUAL CONFIRMATION DEVICE AND RESERVOIR-FORMING MEMBER

BACKGROUND OF THE INVENTION

1. Field of the Invention

The present invention relates to a device to quantify the amount of liquid so as to allow visual confirmation of the internal liquid level in a reservoir from the outside. The present invention also relates to a reservoir-forming member that can be suitably applied as a component element in the liquid quantity visual confirmation device. The present invention further relates to an internal combustion engine permitting visual confirmation of the internal liquid quantity in a reservoir from the outside.

2. Description of the Related Art

Liquid quantity visual confirmation devices for permitting visual confirmation of the quantity of a liquid in a container from the outside, such as an oil quantity confirmation device is known. One such device provides an opening in the oil pan side wall of an engine, and provides a gauge member comprising a transparent material having an inclined surface thereby permitting visual confirmation from above at a position covering the opening (see Japanese Unexamined Utility Model Publication No. 63-73515).

Conventional gauge members were only capable of permitting visual confirmation from the outside of the liquid level in a container, and have not been improved on since.

SUMMARY OF THE INVENTION

It is therefore an object of the present invention to provide a liquid quantity visual confirmation device, which permits, among other things, visual confirmation of the liquid quantity in a reservoir from the outside.

Another object of the present invention is to provide a reservoir-forming member suitably applicable as a component element of the above-mentioned liquid quantity visual confirmation device.

Still another object of the present invention is to provide an internal combustion engine permitting visual confirmation of the liquid quantity in a reservoir from the outside and easy liquid-feeding operation into the reservoir.

A liquid quantity visual confirmation device of an embodiment of the present invention comprises a first reservoir-forming member and a second reservoir-forming member which form a reservoir in combination, wherein the second reservoir-forming member is at least partially transparent to allow visual confirmation of an the internal liquid level from an outside of the device, said second reservoir-forming member comprising a liquid-feeding port for feeding a liquid into the reservoir.

According to the present invention, the liquid quantity in the reservoir can easily be confirmed by viewing the internal level from the outside through the transparent portion of the second reservoir-forming member. In addition, it is possible to reliably feed the liquid in an appropriate quantity into the reservoir while confirming the increase in the liquid level through the transparent portion, since the second reservoir-forming member has the liquid-feeding port.

As a preferable embodiment of the present invention, the liquid quantity visual confirmation device may further comprise a detachable lid which covers the liquid-feeding port.

As another preferable embodiment of the present invention, the second reservoir-forming member may be made detachable from the first reservoir-forming member. This facilitates a cleaning operation or an inspecting operation of the first and the second reservoir-forming members.

As still another preferable embodiment of the present invention, the second reservoir-forming member may be held by the mutual connection of divided pieces forming the first reservoir-forming member in mutual combination. In this case, the second reservoir-forming member is separated from the first reservoir-forming member by releasing the mutual connection of the divided pieces. This permits reliable fixing of the second reservoir-forming member with a simple configuration.

As another further preferable embodiment of the present invention, the second reservoir-forming member may be screw-connected to the first reservoir-forming member. This facilitates attachment and detachment operations of the second reservoir-forming member to and from the first reservoir-forming member. As compared with a pressure-connecting operation, the second reservoir-forming member becomes harder to come off the first reservoir-forming member, thus providing a preferable manner of operation.

A reservoir according to an embodiment of the present invention comprises a reservoir-forming member which is a second reservoir-forming member in combination with a first reservoir-forming member, said second reservoir-forming member being at least partially transparent to allow visual confirmation of an internal liquid level from an outside thereof, and said second reservoir-forming member further comprising a liquid feeding port for feeding the liquid into the reservoir.

An internal combustion engine according to an embodiment of the present invention has a vessel main body and a cylinder forming a reservoir in mutual combination; wherein the cylinder is at least partially transparent to allow visual confirmation of the internal liquid level from an outside thereof, and an upper end of the cylinder serves as an opening-closing liquid feeding port for feeding the liquid into the reservoir.

In the internal combustion engine, the liquid quantity in the reservoir can be easily confirmed by viewing the internal liquid level from the outside through the transparent portion of the cylinder. In addition, since the upper end of the cylinder serves as the liquid-feeding port, the liquid in an appropriate quantity can be fed into the reservoir while confirming the rising of the liquid level through the transparent portion of the cylinder. This eliminates the risk of failure due to, e.g., over-feeding of the liquid, and permits avoidance of problems such as leakage of the liquid to outside during the liquid-feeding operation.

DESCRIPTION OF THE PREFERRED EMBODIMENTS

Figure 1:
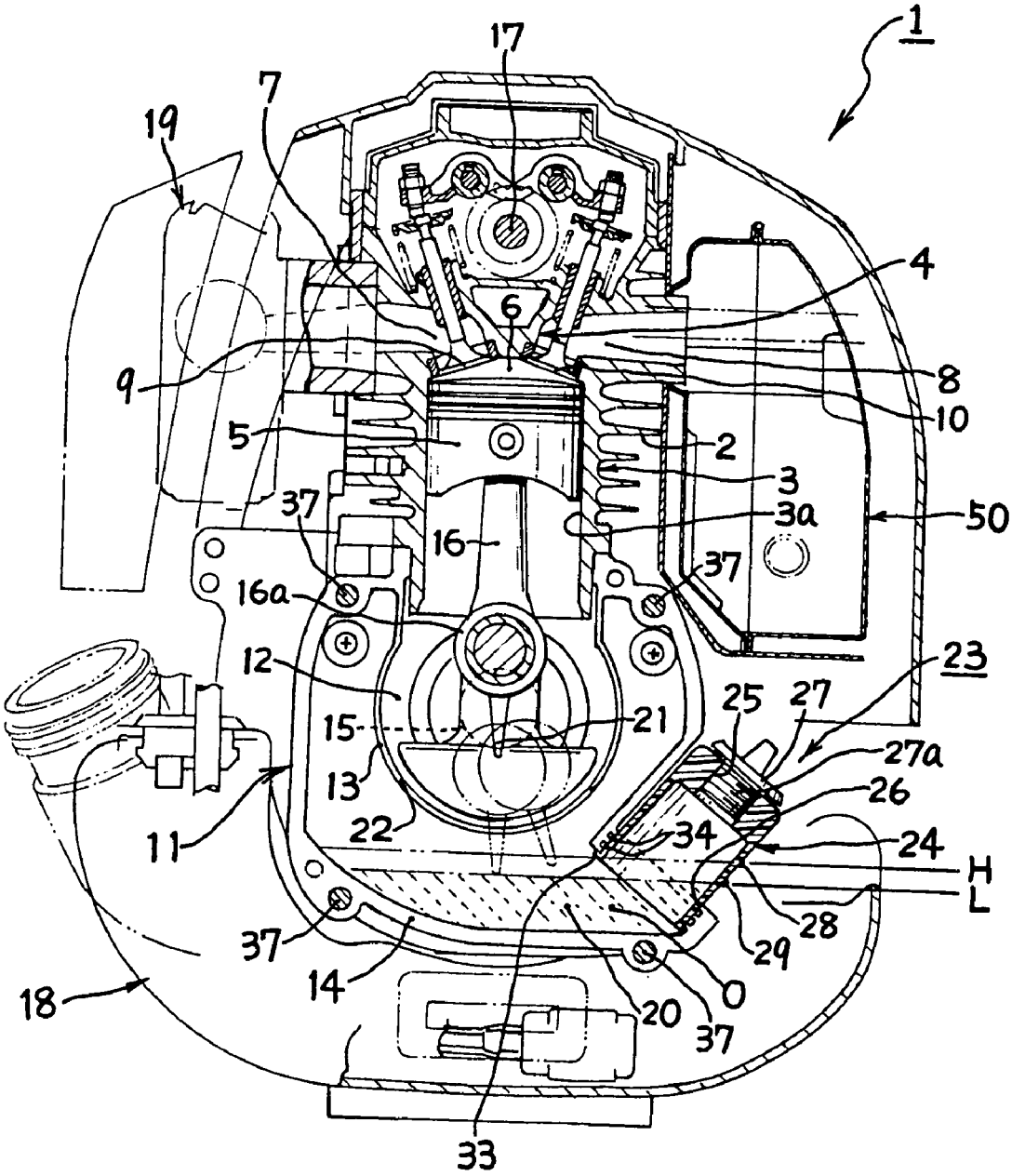
FIG. 1 is a longitudinal sectional view schematically illustrating a four-stroke internal combustion engine, which is an internal combustion engine containing the liquid quantity visual confirmation device of an embodiment of the present invention.

The four-stroke internal combustion engine 1 shown in FIG. 1 is a relatively small engine having a displacement of about 20 ml to 60 ml suitable as an engine for a portable working machine such as a lawn mower or a hedge trimmer. The internal combustion engine 1 contains a liquid quantity visual confirmation device 23 according to an embodiment of the present invention.

In FIG. 1, the internal combustion engine 1 comprises a cylinder block 3 having a cooling fin 2 for air cooling, and a cylinder head 4 fixed integrally on the cylinder block 3. A piston 5 is vertically and slidably inserted into a cylinder bore 3*a* of the cylinder block 3, and a combustion chamber 6 is provided between the piston 5 and the cylinder head 4.

An ignition plug (not shown) is arranged in the cylinder head 4 so as to face the combustion chamber 6, and an air inlet port 7 and an air discharge port 8 are formed so as to open in the combustion chamber 6. The air inlet port 7 is opened or closed by an air inlet valve 9, and the air discharge port 8 is opened or closed by an air discharge valve 10.

A crankcase 11 also serving as an oil tank, which is the liquid container main body, is connected and secured to the lower end of the cylinder block 3. The crankcase 11 comprises an inner wall 13 consisting of a crank chamber 12, and an outer wall 14 forming an oil reservoir 20 serving as a liquid reservoir in the space between the oil reservoir 20 and the inner wall 13. A crankshaft 15 arranged in the crank chamber 12 is connected to the piston 5 via a connecting rod 16.

The crankshaft 15 is connected to a cam shaft 17 via a timing belt (not shown). As a result, the air inlet valve 9 and the air discharge valve 10 are opened or closed at a prescribed timing in synchronization with the rotation of the crankshaft 15.

A fuel tank 18 is positioned below, and in the proximity of, the crankcase 11. Gasoline in the fuel tank 18 is atomized as a mixed gas with air in a carburetor 19, and then passed to the combustion chamber 6 via the air inlet port 7, and combustion exhaust gas is discharged via an exhaust pipe 50.

In the above-mentioned configuration, the crankshaft 15 is rotated by repeated suction, compression, expansion and exhaust steps, and a power-operated member such as a cutting blade is driven via a centrifugal clutch and a power transmission shaft (not shown) connected to the crankshaft 15.

Lubrication of the individual parts during the operation of the internal combustion engine 1 is achieved by oil O, which is a liquid in the oil reservoir 20. In this configuration, as an example of the means for atomizing the oil O, an oil dipper 21 is formed integrally with a larger end 16*a* of the connecting rod 16. The oil dipper 21 extends straight downward in the longitudinal direction of the connecting rod 16. A slit 22 allowing access to the oil dipper 21 is formed in the lower part of the inner wall 13 of the crankcase 11. The oil dipper 21 repeats a cycle of dipping into the oil reservoir 20 and retracting into the crank chamber 12 via the slit 22 under the effect of the rotation of the crankshaft 15. As a result, the lower end of the oil dipper 21 comes into contact with the oil O in the oil reservoir 20, pushes the oil 0 up into the crank chamber 12 and the cylinder block 3, thus lubricating the individual parts of the engine.

The liquid quantity visual confirmation device 23 of this embodiment will now be described.

The oil quantity visual confirmation device 23 comprises a first reservoir-forming member 11 which is made of die-cast-formed aluminum alloy, and a second reservoir-forming member 24. The first and second reservoir-forming members 11, 24 form the oil reservoir 20 in combination. The second reservoir-forming member 24 is partially transparent to allow visual confirmation of the internal liquid level from the outside, and has a liquid-feeding port 25 to feed oil O into the oil reservoir 20.

More specifically, the oil reservoir 20 is formed by a combination of the crankcase 11 serving as the first reservoir-forming member, and a cylinder 24 serving as the second reservoir-forming member. An opening 26 is formed in the crankcase 11, and the cylinder 24 is liquid-tightly connected to the opening 26. In the state where the cylinder 24 is connected to the opening 26, the cylinder 24 extends diagonally upward. In the state in which the crankcase 11 and the cylinder 24 are mutually combined, the entire contour substantially agrees with that of a conventional crankcase having a liquid-feeding port.

The upper end opening of the cylinder 24 serves as the oil feeding port 25 as the above-mentioned liquid-feeding port. The oil-feeding port 25 has a female screw on the inner peripheral surface thereof, and can be closed by a detachable cap 27 as a lid having a screwing portion 27*a* engaging with the female screw. In this embodiment, the cylinder 24 is a cylindrically formed plastic, and the entire cylinder 24 is transparent so that the liquid level in the cylinder 24 can be visually confirmed from the outside. For this purpose, the transparent portion may be only a part of the cylinder 24.

An upper mark 28 showing the highest allowable liquid level H of the oil reservoir 20 and a lower mark 29 corresponding to the lowest allowable liquid level L of the oil reservoir 20 are provided on the transparent portion of the cylinder 24. As shown in FIG. 1, the oil O is fed to the upper mark 28, and replenished when the liquid level comes down to the lower mark 29 as a result of the decrease caused by lubrication.

The crankcase 11, being fixed to the cylinder block 3 which has a high temperature, is usually made in its entirety of a nontransparent heat-resistant material such as an aluminum alloy. Therefore, the liquid level of the oil O in the crankcase 11 cannot be seen from the outside. According to this embodiment of the present invention, in contrast, the operator can confirm the quantity of the oil O in the oil reservoir 20 only by looking at the cylinder 24 from the outside. It is therefore possible to easily and accurately grasp the refill timing of the oil O without having to remove the cap 27 every time.

When refill (supplying) the oil, the operator pours the new oil O from the oil feeding port 25 while watching the liquid level of the oil O in the cylinder 24 from outside. The oil-feeding port 25 is provided at the upper end of the cylinder 24, which is formed into a relatively short size. The operator can therefore simultaneously watch the oil feeding port 25 and the liquid level in the cylinder 24 from the outside. This eliminates the risk of failures such as overfeeding of the oil, or oil spillage during the oil refill operation.

In this embodiment, the cylinder 24 is detachable from the opening 26 of the crankcase 11. Any cleaning operation or inspections of the cylinder 24 can therefore be easily and suitably carried out. Particularly, since some of the oil can become contaminated after lubrication, the inner peripheral surface of the cylinder 24 tends to be easily stained. However, since the cylinder 24 is detachable, cleaning thereof can be accomplished easily and reliably. It is therefore possible to easily and reliably prevent a decrease in visual confirmation ability of the liquid level of the oil O in the cylinder 24 from the outside.

Figure 2:
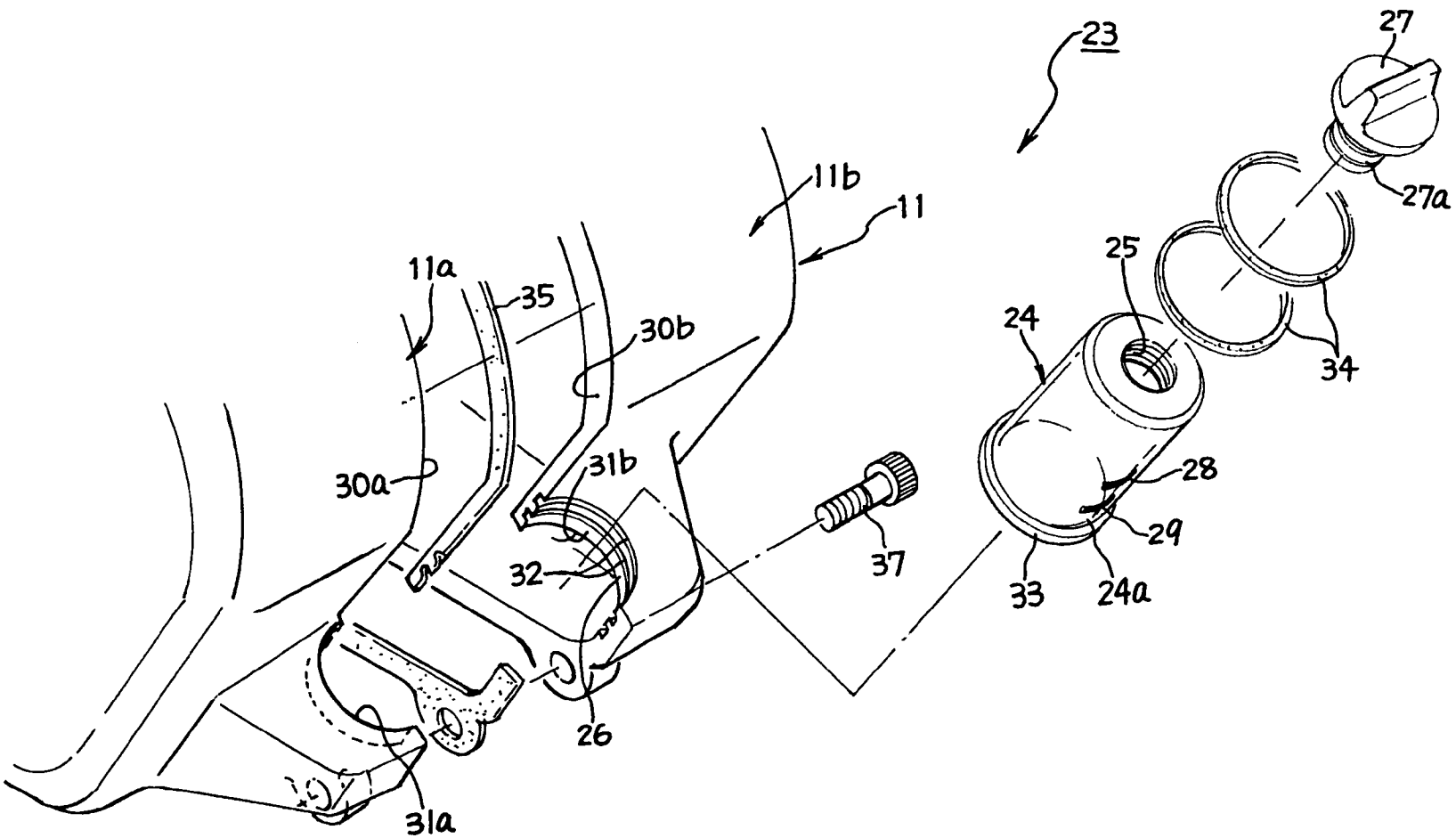
FIG. 2 is a partial exploded perspective view of FIG. 1.

In this embodiment, as shown in FIG. 2, the opening 26 is formed at joints 30*a* and 30*b* having a mutual connection with the divided pieces forming the crankcase 11, and the cylinder 24 is held by the mutual combination between these divided pieces 11*a* and 11*b*. More specifically, at positions corresponding to each other of the joints 30*a* and 30*b* of the divided pieces 11*a* and 11*b*, semi-circular concavities 31*a* and 31*b* corresponding to the outer periphery of the lower end 24*a* of the cylinder 24 are formed in a notch shape. Sealing material engagement grooves 32 are formed on the inner periphery of the concavities 31*a* and 31*b*. At the lower end 24*a* of the cylinder 24 a flange 33 engaging with the inner surface of the crankcase 11 is formed as an engagement for attachment positioning and to prevent detachment.

When assembling the crankcase 11, a ring of a sealing material 34 is attached to the outer peripheral surface of the lower end 24*a* of the cylinder 24, and the sealing material 34 is fitted into the sealing material engagement groove 32 of the divided piece 30*b*. A sealing material 35 is also provided between the joints 30*a* and 30*b* of the divided pieces 11*a* and *b*. The two divided pieces 11*a* and 11*b* are mutually combined so that the lower end 24*a* of the cylinder 24 is held between the two divided pieces 11*a* and 11*b*, and are tightened with bolts 37. Therefore, when attaching or detaching the cap 27, the cylinder 24 can be firmly held so that inconveniences such as rotation of the cylinder 24 together with the cap 27 can be avoided.

In the above-mentioned configuration, the cylinder 24 can be separated from the crankcase 11 by releasing the mutual connection of the two divided pieces 11*a* and 11*b* by removing the bolts 37. This makes it easier to carry out the cleaning and inspection operations of the cylinder 24 as well as the cleaning and inspection operations of the crankcase 11.

Figure 3:
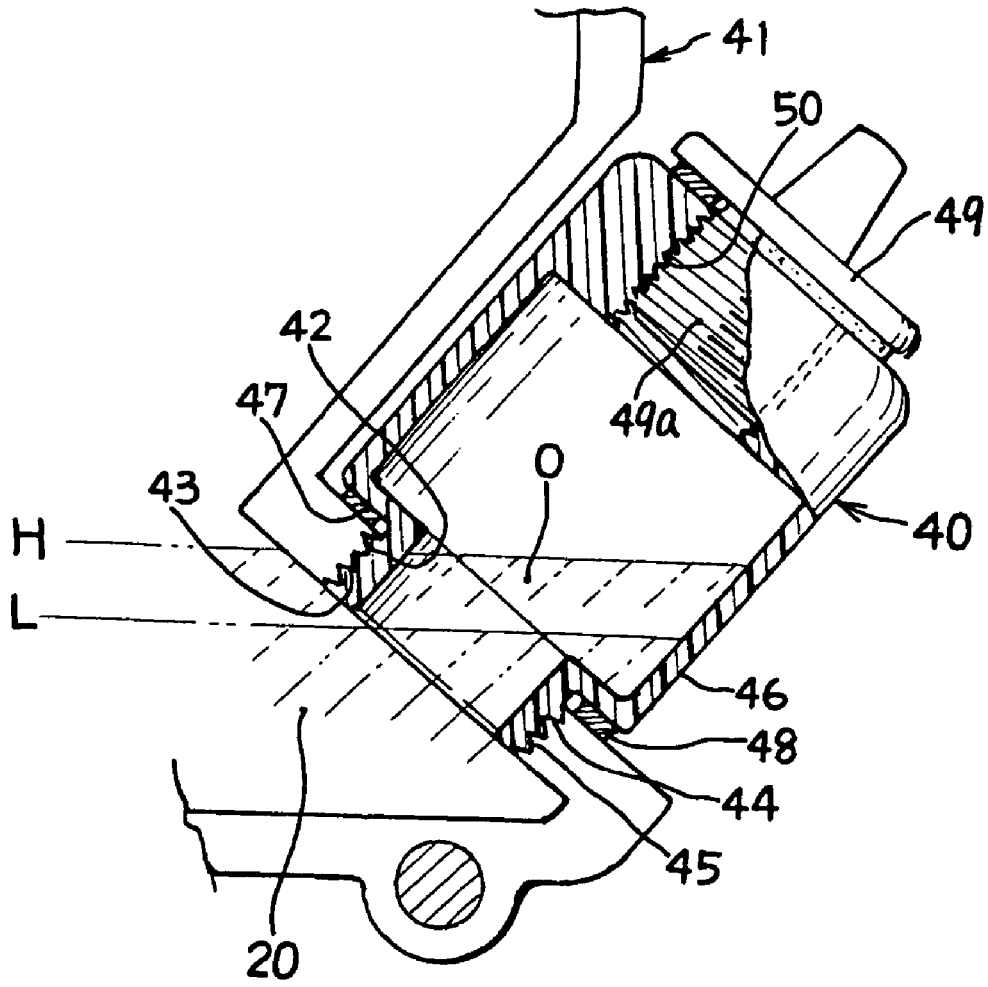
FIG. 3 is a partial sectional view of the liquid quantity visual confirmation device of another embodiment of the present invention.

As another embodiment, as shown in FIG. 3, a cylinder 40 serving as the second reservoir-forming member may be screw-connected to a crankcase 41 serving as the first reservoir-forming member. More specifically, an opening 42 for attaching the cylinder 40 to the crankcase 41 serving as the container main body, and a female screw 43 is formed on the inner peripheral surface of the opening 42. In contrast, a male screw 45 engaging with the female screw 43 is formed on the outer peripheral surface of the shorter-diameter lower end 44 of the cylinder 40. A sealing member 48 is provided between a step 47 between the longer-diameter portion 46 of the cylinder 40 and the shorter-diameter lower end 44 and the crankcase 41 to screw-connect the cylinder 40 to the opening 42.

Through these steps, it is possible to suitably facilitate the attaching and detaching operations of the cylinder 40 to and from the crankcase 41. In this case, the opening 42 can be formed at a position other than the joints of the divided pieces of the crankcase 41, unlike that shown in FIG. 2. Replenishment of the oil O can be accomplished from an oil-feeding port 50 at the upper end of the cylinder 40 by removing the cap 49, and apart from this, from the opening 42 by removing the cylinder 40 from the crank case 41 by directing the opening 42 of the crankcase 41 upward.

An inconvenience such as rotation of the cylinder 40 together with the cap 49 can be avoided by making the diameter of the screwing portion 49*a* of the cap 49 sufficiently smaller than the diameter of the male screw 45 of the cylinder 40.

The liquid quantity visual confirmation device of the above-mentioned embodiments was invented during the process of developments in the field of engines. However, there are no limitations to the range of applications thereof, and this technology is applicable to any container containing a liquid.

What is claimed is:

1. An internal combustion engine having a container main body and a cylinder forming a reservoir in mutual combination; wherein said cylinder is at least partially transparent to allow visual confirmation of an internal liquid level from an outside thereof, and an upper end of said cylinder serves as an opening-closing liquid-feeding port for feeding the liquid into said reservoir, wherein said cylinder is screw-connected to said container main body, and wherein said cylinder includes, on one end, a male screw that engages with a female screw on said container main body and, on another end, a female screw that receives a corresponding male screw of a filler cap, wherein the male screw of the filler cap has a diameter that is smaller than a diameter of the male screw that engages with the female screw of said container main body.

2. The internal combustion engine according to claim 1, wherein said cylinder is detachable from said container main body.

3. The internal combustion engine according to claim 1, wherein said cylinder is held in place by the mutual combination of divided pieces forming said container main body in mutual combination.

* * * * *